US005267357A

United States Patent [19]

Ades

[11] Patent Number: 5,267,357

[45] Date of Patent: Dec. 7, 1993

[54] RELEASABLE TOILET LID AND SEAT LOCKING APPARATUS

[76] Inventor: Bruce A. Ades, 763 Plaza Hermosa, Novato, Calif. 94947

[21] Appl. No.: 46,643

[22] Filed: Apr. 13, 1993

[51] Int. Cl.[5] ..... A47K 13/12; A47K 13/24

[52] U.S. Cl. ..... 4/253; 4/240; 4/245.3; 4/236

[58] Field of Search ..... 4/236, 240, 253, 245.3, 4/234, 237, 235

[56] References Cited

U.S. PATENT DOCUMENTS

| | | | |
|---|---|---|---|
| 2,431,263 | 11/1947 | Lundgren | 4/253 |
| 2,578,153 | 12/1951 | Schmitz | 4/253 |
| 4,658,447 | 4/1987 | Smith | 4/236 |
| 4,724,551 | 2/1988 | Gardner | 4/253 |
| 4,833,737 | 5/1989 | Boucher et al. | 4/253 |
| 4,894,870 | 1/1990 | Buckshaw et al. | 4/253 |

*Primary Examiner*—Henry J. Recla
*Assistant Examiner*—Gregory Vidovich
*Attorney, Agent, or Firm*—John R. Flanagan

[57] ABSTRACT

A lid and seat locking apparatus for a toilet includes a mounting assembly, an elongated rod, and an actuating assembly. The mounting assembly is attachable to the flush tank at a location spaced above the bowl. The rod couples the seat and lid to the mounting assembly to undergo pivotal movement about a pivot axis between a lowered position in which the seat and lid cover a top opening of the bowl and a raised position in which the seat and lid uncover the bowl top opening. Hinge brackets on the seat and lid are pivotally attachable to the rod. The rod and actuating assembly are mounted to the mounting assembly for sliding movement relative thereto between locking and unlocking positions along the pivotal axis of the seat and lid. The rod has a pair of radial pins mounted thereon adjacent to selected ones of the seat and lid hinge brackets. The pins are matable with and unmatable from transverse slots defined in the selected seat and lid hinge brackets such that the seat and lid are retained in the lowered position when the rod and actuating assembly are at the locking position and the pins are mated with the slots. The seat and lid are pivotally movable to the raised position when the rod and actuating assembly are at the unlocking position and the pins are unmated from the slots.

26 Claims, 2 Drawing Sheets

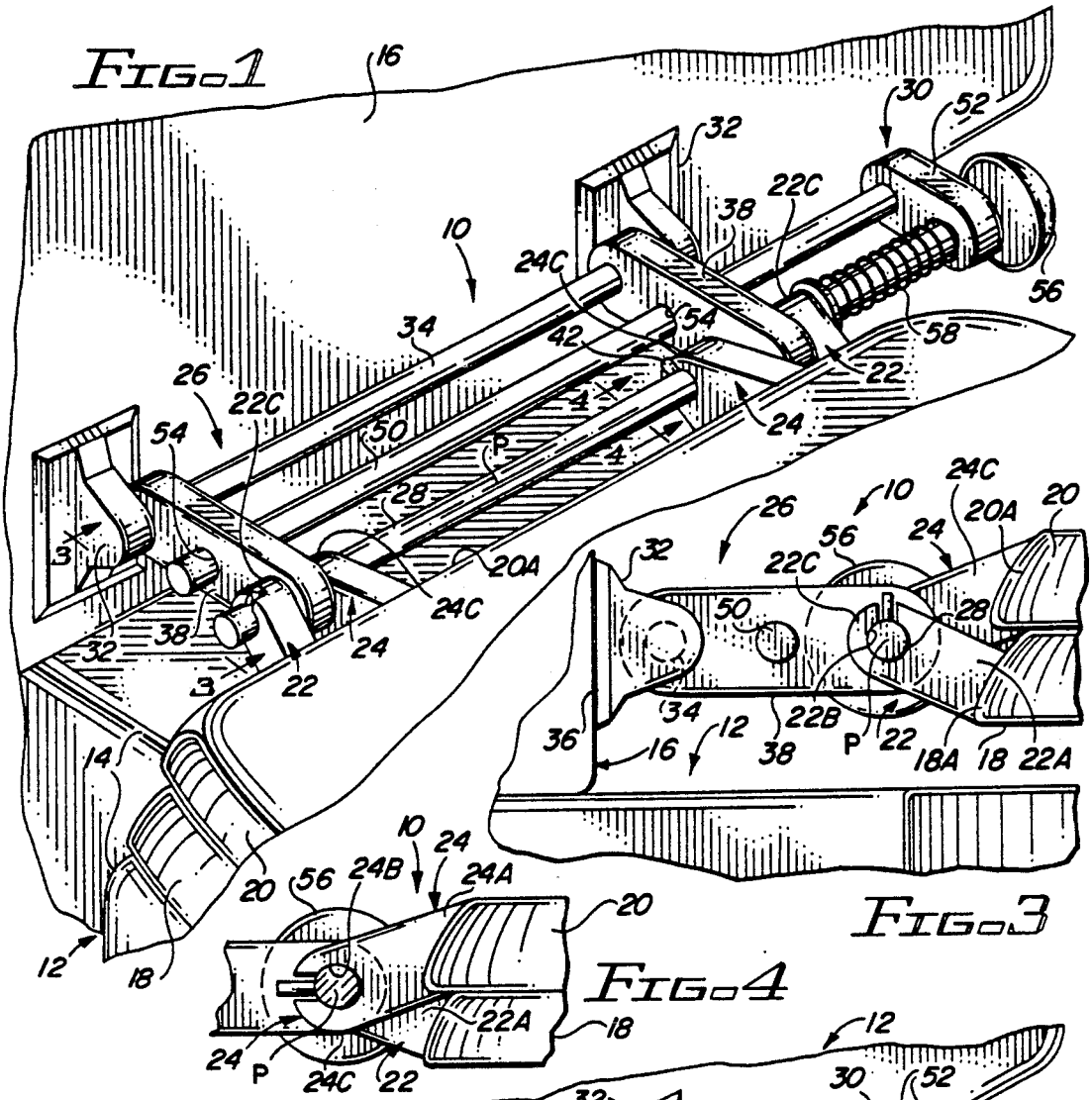
FIG. 3
FIG. 4
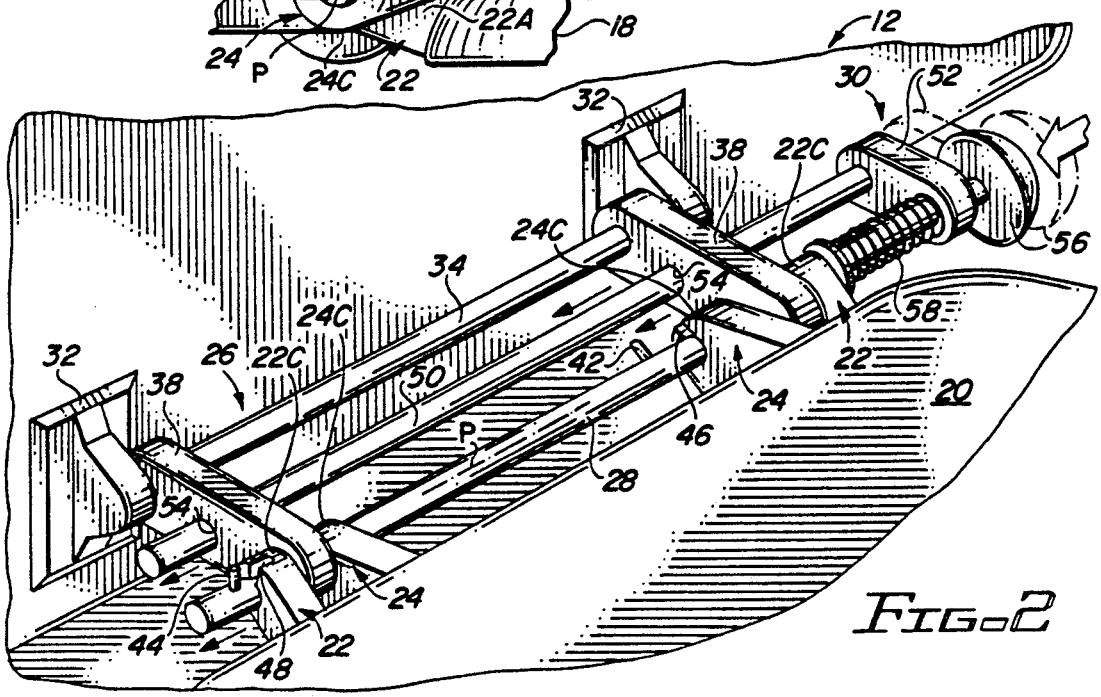
FIG. 2

RELEASABLE TOILET LID AND SEAT LOCKING APPARATUS

BACKGROUND OF THE INVENTION

1. Field of the Invention

The present invention generally relates to devices for locking seat and lids of a toilet and, more particularly, is concerned with a releasable lid and seat locking apparatus which facilitates thorough cleaning and security of the toilet.

2. Description of the Prior Art

A toilet of well-known construction and employed in most homes has a bowl installed upon the bathroom floor, a flush tank located rearwardly and above the bowl and in flow communication with the bowl, a seat overlying an open top of the bowl and a cover or lid overlying the seat. The toilet seat and lid are typically pivotally mounted on a portion of the bowl rearwardly from its open top by a hinge assembly which includes an elongated shaft and a plurality of mounting brackets and seat and lid brackets. The mounting brackets are typically fastened on the upper surface of the rearward portion of the bowl. The seat brackets are fixedly attached to the rear edge portion of the seat while the lid brackets are fixedly attached to the rear edge portion of the lid. The mounting brackets and the seat and lid brackets having respective passages which are alignable to receive the shaft therethrough. By the use of such hinge assembly, the seat and lid are coupled to the bowl for undergoing pivotal movement between a lowered position in which they cover the open top of the bowl and a raised position in which they uncover the open top of the bowl and lean backwards against the front wall of the toilet flush tank.

The toilet of the above-described construction has been highly successful from a functional and commercial standpoint as evidenced by its widespread acceptance and use. However, this toilet construction has several drawbacks.

A first drawback is the difficulty of thoroughly cleaning the top surface region of the bowl around the mounting brackets and under the elongated shaft of the hinge assembly which pivotally mounts the seat and lid to the bowl. As a result, unsanitary conditions often arise and persist on this region of the bowl.

A second drawback is the ease by which even small children can lift the seat and lid. This is due to the lightweight materials used to construct these components of the toilet. Oftentimes an uncovered toilet bowl presents an attraction for small children to either fall or throw objects into the bowl and an opportunity for pets to drink water from the bowl. It is highly desirable to prevent both of these situations from happening.

Numerous locking devices have been proposed in the prior art to overcome the second but not the first drawback. Representative examples of these locking devices are the ones disclosed in U.S. Pat. Nos. to Smith (4,658,447), Gardner (4,724,551), Boucher et al (4,833,737) and Buchshaw et al (4,894,870). However, none of these locking devices provides a comprehensive solution which overcomes both drawbacks.

Consequently, a need still exists for a toilet seat and lid locking arrangement which effectively addresses both of the above-described drawbacks.

SUMMARY OF THE INVENTION

The present invention provides a releasable toilet lid and seat locking apparatus designed to satisfy the aforementioned need. The lid and seat locking apparatus of the present invention ensures retention of the toilet lid and seat in the closed position when the toilet is not in use and facilitates easy access to and cleaning of the top surface of the toilet bowl.

Accordingly, the present invention is directed to a lid and seat locking apparatus for use in conjunction with a toilet which includes a bowl having a top opening, a flush tank located rearwardly and above the bowl, a seat overlying the top opening of the bowl, and a lid overlying the seat. The seat and lid respectively have pairs of spaced seat and lid hinge brackets fixed on rear edge portions thereof and having end portions protruding from the rear edge portions of the seat and lid.

The lid and seat locking apparatus of the present invention comprises: (a) means attachable to the toilet for mounting the seat and lid to undergo pivotal movement about a pivot axis relative to the flush tank and bowl between a lowered position in which the seat and lid cover the top opening of the bowl and a raised position in which the seat and lid uncover the top opening of the bowl; and (b) means for pivotally coupling the end portions of the seat and lid hinge brackets to the mounting means, the coupling means also being slidably movable relative to the mounting means and the seat and lid hinge brackets between locking and unlocking positions along the pivotal axis of the seat and lid. The coupling means includes a pair of pins disposed adjacent to end portions of selected ones of the seat and lid hinge brackets and extending in radial relation to the pivot axis of the seat and lid. Upon sliding movement of the coupling means between the locking and unlocking positions with the seat and lid in the lowered position, the radial pins are matable with and unmatable from slots defined in the selected ones of the end portions of the seat and lid hinge brackets and in transverse relation to the pivot axis. The seat and lid are retained in the lowered position when the radial pins are mated with the transverse slots, whereas the seat and lid are pivotally movable to the raised position when the radial pins are unmated from the transverse slots.

More particularly, the mounting means is a mounting assembly which includes a pair of mounting brackets and an elongated shaft extending between and interconnecting the mounting brackets. The mounting assembly also includes fastening members connected to the mounting brackets and adapted to attach the mounting brackets to the toilet flush tank at a location spaced above a portion of the toilet bowl rearwardly from the open top of the bowl and thereby mount the toilet seat and lid via the coupling means in spaced relation above the rearward portion of the toilet bowl. The mounting assembly further includes a pair of link members mounted in fixed relation to the shaft and mounting brackets and extending forwardly therefrom toward the seat and lid.

The coupling means includes an elongated coupling rod and an actuating assembly connected to the coupling rod. The coupling rod is mounted through a pair of holes defined in the forward ends of the link members of the mounting assembly for undergoing sliding movement relative thereto. The seat and lid hinge brackets have passages defined in their end portions through which the coupling rod is inserted so as to couple the seat and lid to the coupling rod for pivotal movement between lowered and raised positions about a pivot axis defined by the coupling rod. Also, the coupling rod is slidable relative to the seat and lid hinge brackets between locking and unlocking positions along the pivotal axis of the seat and lid. Further, the elongated rod has the pair of radial pins mounted thereon adjacent to the selected ones of the seat and lid hinge brackets. The seat and lid are retained and locked in the lowered position when the coupling rod is at the locking position and the radial pins are mated with the transverse slots. The seat and lid are pivotally movable to the raised position when the coupling rod is moved to the unlocking position and the radial pins are unmated from the transverse slots.

The actuating assembly is connected to the coupling rod and mounted to the mounting assembly for undergoing sliding movement relative to the mounting assembly to thereby cause sliding movement of the coupling rod relative to the seat and lid hinge brackets between the locking and unlocking positions along the pivotal axis of the seat and lid. The actuating assembly includes an elongated guiding rod and a cross brace rigidly interconnecting the guiding rod and the coupling rod so that they extend in generally parallel relation to one another. The guiding rod is mounted through a pair of apertures defined in the middle of the link members of the mounting assembly for undergoing sliding movement concurrently with sliding movement of the coupling rod. A coiled spring encircles one of the coupling and guiding rods for biasing the coupling rod toward the locking position. A knob is provided on an end of the coupling rod for gripping to move the coupling and guiding rods.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which:

FIG. 1 is a perspective view of a releasable toilet lid and seat locking apparatus of the present invention being shown in a locked condition.

FIG. 2 is a perspective view similar to that of FIG. 1, but showing the locking apparatus actuated to an unlocked condition.

FIG. 3 is an enlarged fragmentary side elevational view of the locking apparatus as seen along line 3—3 of FIG. 1.

FIG. 4 is an enlarged fragmentary side elevational view of the locking apparatus as seen along line 4—4 of FIG. 1.

DETAILED DESCRIPTION OF THE INVENTION

Figure 5:
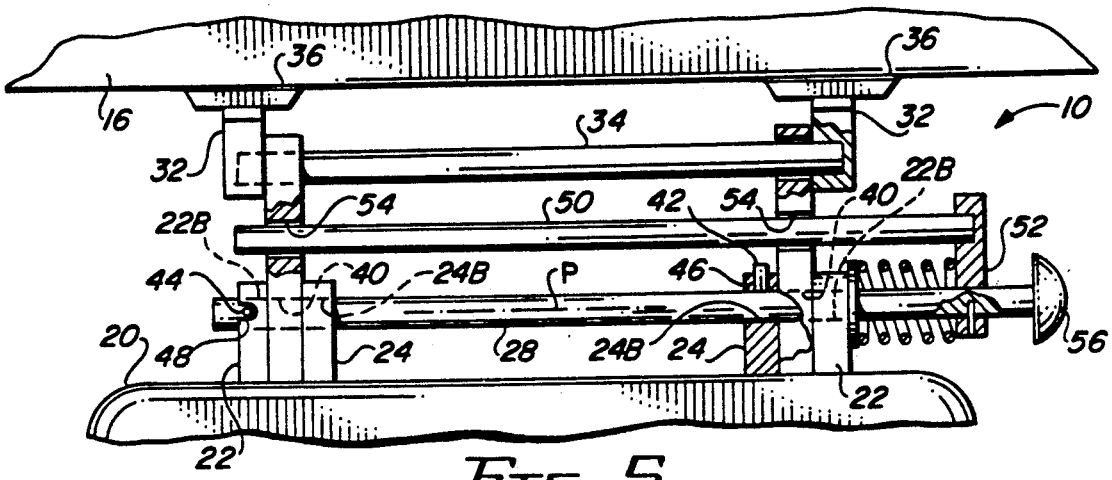
FIG. 5 is a top plan view of the locking apparatus of FIG. 1.

Referring to the drawings and particularly to FIGS. 1 and 2, there is illustrated a releasable toilet seat and lid locking apparatus of the present invention, being generally designated 10. The seat and lid locking apparatus 10 is employed in conjunction with a toilet 12 having a conventional construction.

As is well-known, basically the toilet 12 has a bowl 14 secured upon a bathroom floor (not shown), and a flush tank 16 located rearwardly and above the bowl 14 and in fluid flow communication with the bowl 14. The toilet 12 also includes an oval-shaped annular seat 18 overlying an open top 14A of the bowl 14 and a cover or lid 20 overlying the seat 18.

The toilet 12 also includes respective pairs of seat and lid hinge brackets 22, 24 used in pivotally mounting the seat 18 and lid 20 in a manner to be described below. Preferably, the seat hinge brackets 22 are laterally spaced from one another and fixedly attached at forward portions 22A by any suitable means to a rear edge portion 18A of the seat 18. Also, preferably, the lid hinge brackets 24 are laterally spaced from one another and located adjacent to but spaced from the seat hinge brackets 22. The lid hinge brackets 24 are fixedly attached at forward portions 24A by any suitable means to a rear edge portion 20A of the lid 20. The seat and lid hinge brackets 22, 24 have respective passages 22B, 24B defined through rearward portions 22C, 24C thereof. The rearward portions 22C, 24C of the respective seat and lid hinge brackets 22, 24 protrude beyond the respective rear edge portions 18A, 20A of the seat 18 and lid 20.

Referring to FIGS. 1–5, in its basic components, the lid and seat locking apparatus 10 includes a mounting assembly 26, an elongated coupling rod 28 and an actuating assembly 30. The mounting assembly 26 of the locking apparatus 10 includes a pair of mounting brackets 32 and an elongated shaft 34 extending between and rigidly interconnecting the mounting brackets 32. The mounting assembly 26 also includes fastening members 36 connected to the rear sides of the mounting brackets 32 and adapted to attach the mounting brackets 32 to the flush tank 16 at the location spaced above the rearward portion of the bowl 14. The fastening members 36 can be complementary patches of hook and look fastening material respectively secured to the desired locations on the front face or surface of the tank 16 (as seen in FIGS. 1 and 2) and on the rear sides of the mounting brackets 32. The mounting assembly 26 further includes a pair of rigid link members 38 mounted in fixed relation to the elongated shaft 34 and mounting brackets 32 and extending forwardly therefrom toward the seat 18 and lid 20.

Figure 6:
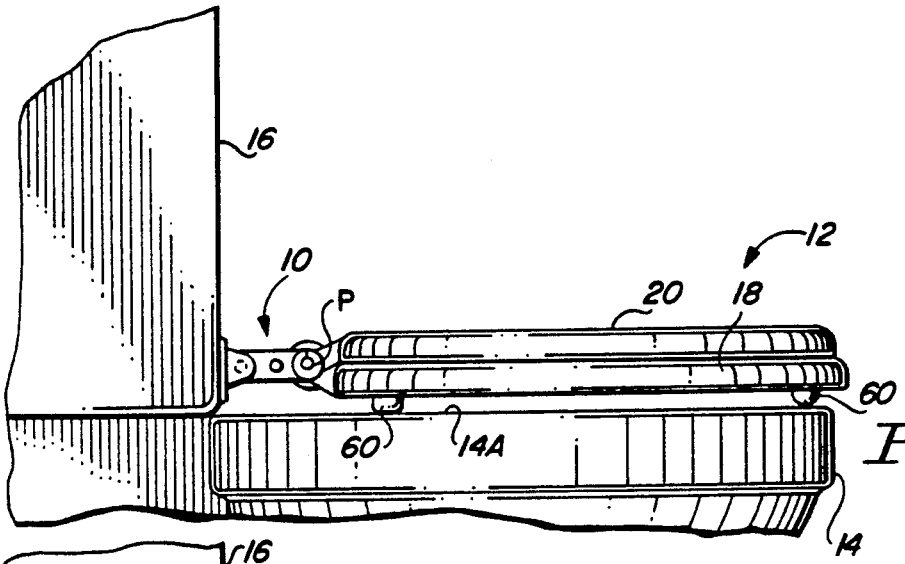
FIG. 6 is a side elevational view of the toilet seat and lid in a lowered position covering the toilet bowl.
Figure 7:
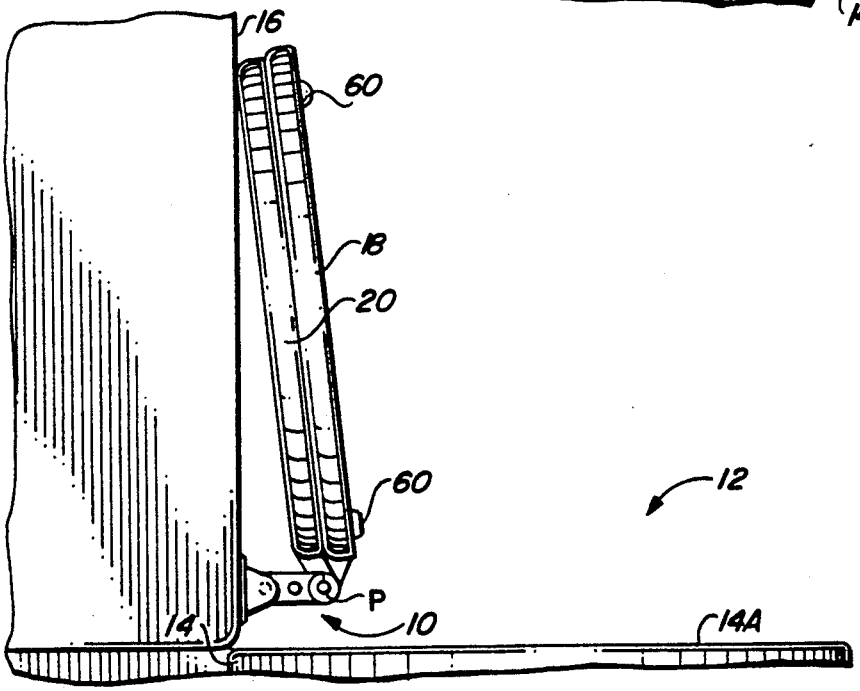
FIG. 7 is a side elevational view of the toilet seat and lid in a raised position uncovering the toilet bowl.

The elongated coupling rod 28 of the locking apparatus 10 is mounted through a pair of holes 40 (Fig. 5) defined in the forward or outer ends of the link members 38 of the mounting assembly 26 for undergoing both pivotal and sliding movement relative thereto and about and along the pivot axis P of the seat 18 and lid 20 which is defined by the coupling rod 28. The seat and lid hinge brackets 22, 24 have passages defined in their rearward end portions 22C, 24C through which the coupling rod 28 is inserted so as to couple the seat 18 and lid 20 to the coupling rod 28 for pivotal movement between lowered and raised positions (respectively shown in FIGS. 6 and 7) about the pivot axis P defined by the coupling rod 28. Also, the coupling rod 28 is slidable relative to the seat and lid hinge brackets 22, 24 between locking and unlocking positions (respectively illustrated in FIGS. 1 and 2) along the pivot axis P of the seat 18 and lid 20. It will be noted from viewing FIGS. 1, 2 and 5 that the seat hinge brackets 22 are located adjacent to outer sides of the fixed link members 38, whereas the lid hinge brackets 24 are located adjacent to inner sides of the fixed link members 38. Due to such mounting relationship with the fixed link members 38, the seat 18 and lid 20 are retained in stationary positions as the elongated coupling rod 28 is slidably moved relative to the mounting assembly and seat 18 and lid 20 along the pivot axis P.

Further, the coupling rod 28 of the locking apparatus 10 has a pair of rigid pins 42, 44 mounted thereon adjacent to selected ones of the seat and lid hinge brackets 22, 24 and extending from the coupling rod 28 in radial relation to the pivot axis P of the seat 18 and lid 20. The radial pins 42, 44 are matable with and unmatable from a pair of slots 46, 48 defined respectively in the selected ones of the seat and lid hinge brackets 22, 24. The slots 46, 48 extend in a radial or transverse relation to the pivot axis P of the seat 18 and lid 20. The seat 18 and lid 20 are retained or locked in the lowered position (FIG. 6) when the coupling rod 28 is disposed at the locking position and the radial pins 42, 44 are mated with the transverse slots 46, 48, as seen in FIG. 1. The seat 18 and lid 10 are pivotally movable to the raised position (FIG. 7) when the coupling rod 28 is shifted to and disposed at the unlocking position and the radial pins 42, 44 are unmated from the transverse slots 46, 48, as seen in FIG. 2.

The actuating assembly 30 of the locking apparatus 10 is connected to the coupling rod 28 and mounted to the mounting assembly 26 for undergoing sliding movement substantially parallel to the pivot axis P of the seat 18 and lid 20 and relative to the mounting assembly 26 to thereby cause sliding movement of the coupling rod 28 relative to the seat and lid hinge brackets 22, 24 between the locking and unlocking positions along the pivot axis P of the seat and lid. More particularly, the actuating assembly 30 includes an elongated guiding rod 50 and a cross brace 52 rigidly interconnecting the guiding rod 50 and the coupling rod 28 so that they extend in generally parallel relation to one another. The guiding rod 50 is mounted through a pair of apertures 54 defined in the middle portion of the link members 38 of the mounting assembly 26 for undergoing sliding movement concurrently and in parallel with sliding movement of the coupling rod 28.

Also, the actuating assembly 30 includes a knob 56 and a coiled spring 58. The knob 56 is attached on an outer end of the coupling rod 28 for gripping to move the coupling and guiding rods 28, 50 in a rectilinear fashion between the locking and unlocking positions. The coiled spring 58 encircles one or the other of the coupling and guiding rods 28, 50 and engages the cross brace 52 so as to bias the coupling rod 28 toward the locking position. The coiled spring 58 provides a predetermined amount of the tension that needs to be overcome in order to slidably move the elongated coupling and guiding rods 28, 50 relative to mounting assembly 26 and to the lid and seat hinge brackets 22, 24 so as to unmate the radial pins 42, 44 from the transverse slots 46, 48 to thereby unlock the seat 18 and lid 20 and thereby permit pivotal moving of the seat 18 and lid 10 from the lowered position to the raised portion. The tension of the spring 58 can be selected so as to be too great for a young child to overcome and so be unable to push the coupling rod 28 inwardly sufficiently to unmate the pins 42, 44 from the slots 46, 48 to unlock the seat 18 and lid 20.

Referring to FIGS. 1, 2, 6 and 7, it can be seen that the mounting assembly 26 is attached to the flush tank 16 at desired locations on the front surface 16A thereof being spaced a short distance, for example 2-3 inches, above the rearward portion of the bowl 14. In such manner, sufficient access is provided under the components of the locking apparatus 10 to facilitate thorough cleaning of the adjacent regions of the top surface 14B of the bowl 14. The mounting assembly 26 mounts the seat 18 and lid 20 via lid and seat hinge brackets 22, 24 and the coupling rod 28, to undergo pivotal movement about the pivot axis P relative to the flush tank 16 and bowl 14 between the lowered position (FIG. 6) in which the seat 18 and lid 20 cover the top opening 14A of the bowl 14 and the raised position (FIG. 7) in which the seat 18 and lid 20 uncover the bowl top opening 14A of the bowl 14. In the lowered position, only bumper elements 60 secured to the underside of the seat 18 near the front edge portion thereof engage the top surface of the front region of the toilet bowl 14.

In summary, therefore, by employing the seat and lid locking apparatus 10 having the above-described construction, the seat 18 and lid 20 are coupled to the flush tank 14 for undergoing pivotal movement between the lowered position in which they cover the open top 14A of the bowl 14 and a raised position in which they uncover the open top 14A of the bowl 14 and lean backwards against the front wall of the flush tank 16. Further, the seat 18 and lid 20 are locked and retained in the lowered position when the coupling rod 28 is at the locking position. The seat 18 and lid 20 are pivotally movable to the raised position when the coupling rod 28 is shifted to the unlocking position by pushing in on the knob 56. The toilet lid and seat locking apparatus 10 of the present invention can be incorporated into a new toilet 10 or retrofitted to an existing toilet 10 having the above-described conventional construction.

It is thought that the present invention and its advantages will be understood from the foregoing description and it will be apparent that various changes may be made thereto without departing from its spirit and scope of the invention or sacrificing all of its material advantages, the form hereinbefore described being merely preferred or exemplary embodiment thereof.

I claim:

1. A locking apparatus for use on a toilet including a bowl having a top opening, a flush tank located rearwardly and above the bowl, a seat overlying the top opening of the bowl, and a lid overlying the seat, the seat and lid having respective pairs of spaced seat and lid hinge brackets fixed on rear edge portions thereof which have end portions protruding from the rear edge portions of the seat and lid, said locking apparatus comprising:

(a) means attachable to the toilet for mounting the seat and lid to undergo pivotal movement about a stationary pivot axis relative to the flush tank and bowl of the toilet between a lowered position in which the seat and lid cover the top opening of the bowl and a raised position in which the seat and lid uncover the top opening of the bowl; and (b) means for pivotally coupling the end portions of the seat and lid hinge brackets on the seat and lid to said mounting means, said coupling means being slidably movable relative to said mounting means and to the seat and lid hinge brackets between locking and unlocking positions along the pivotal axis of the seat and lid, said coupling means including a pair of pins mounted adjacent to end portions of selected ones of the seat and lid hinge brackets and extending in radial relation to the pivot axis, said. radial pins, upon sliding movement of said coupling means between said locking and unlocking positions with the seat and lid in said lowered position, being matable with and unmatable from slots defined in the end portions of the selected ones of the seat and lid hinge brackets in transverse relation to the pivot axis such that the seat and lid are retained in said lowered position when said radial pins are mated with the transverse slots and are pivotally movable to said raised position when said radial pins are unmated from the transverse slots.

2. The locking apparatus of claim 1 wherein said mounting means is a mounting assembly which includes a pair of mounting brackets and an elongated shaft extending between and in rigidly interconnecting the mounting brackets.

3. The locking apparatus of claim 2 wherein said mounting assembly also includes fastening members connected to the mounting brackets and adapted to attach the mounting brackets to the flush tank at a location spaced above a portion of the bowl located rearwardly from the open top of the bowl and thereby mount the seat and lid via the coupling means spaced above the rearward portion of the bowl.

4. The locking apparatus of claim 3 wherein said mounting assembly further includes a pair of link members mounted in fixed relation to the shaft and mounting brackets and extending forwardly therefrom toward the seat and lid.

5. The locking apparatus of claim 4 wherein said coupling means includes an elongated coupling rod mounted through a pair of holes defined in forward ends of said link members of said mounting assembly for undergoing sliding movement relative thereto, along said pivot axis said coupling rods also mountable through passages de in the end portions of the seat and lid hinge brackets so as to couple the seat and lid for pivotal movement between said lowered and raised positions about said pivot axis defined by said coupling rod and for sliding movement between locking and unlocking positions along said pivotal axis.

6. The locking apparatus of claim 5 wherein said coupling rod has said pair of radial pins mounted thereon adjacent to the selected ones of the seat and lid hinge brackets and extending from said coupling rod in radial relation to said pivot axis.

7. The locking apparatus of claim 6 wherein said coupling means also includes an actuating assembly being connected to said coupling rod and mounted to said mounting assembly for undergoing sliding movement relative to said mounting assembly to thereby cause sliding movement of said coupling rod relative to the seat and lid hinge brackets between said locking and unlocking positions along said pivotal axis of the seat and lid.

8. The locking apparatus of claim 7 wherein said actuating assembly includes:

an elongated guiding rod slidaldy associated with said link members, and a cross brace rigidly interconnecting said guiding rod and said coupling rod such that said guiding and coupling rods extend in generally parallel relation to one another.

9. The locking apparatus of claim 8 wherein said guiding rod is mounted through a pair of apertures defined in middle portions of said link members of said mounting assembly for undergoing sliding movement concurrently with sliding movement of said coupling rod.

10. The locking apparatus of claim 9 wherein said actuating assembly also includes a coiled spring which encircles one of said coupling and guiding rods for biasing said coupling rod toward said locking position.

11. The locking apparatus of claim 1 wherein said coupling means includes an elongated coupling rod pivotally connected to said mounting means, and pivotally coupling the seat and lid, via the seat and lid hinge brackets thereof, for pivotal movement between said lowered and raised postions about said pivot axis defined by said coupling rod, said coupling rod also being connected to said mounting assembly and the seat and lid hinge brackets for undergoing sliding movement relative thereto between said locking and unlocking positions along said pivotal axis.

12. The locking apparatus of claim 11 wherein said coupling rod has said pair of pins mounted thereon adjacent to selected ones of the seat and lid hinge brackets and extending from said coupling rod in radial relation to said pivot axis.

13. The locking apparatus of claim 12 wherein said coupling means also includes an actuating assembly being connected to said coupling rod and mounted to said mounting assembly for undergoing sliding movement relative to said mounting assembly to thereby cause sliding movement of said coupling rod relative to the seat and lid hinge brackets between said locking and unlocking positions along said pivotal axis.

14. The locking apparatus of claim 13 wherein said actuating assembly includes:

an elongated guiding rod slidaldy associated with said link members; and a cross brace rigidly interconnecting said guiding rod and said coupling rod such that said guiding and coupling rods extend in generally parallel relation to one another.

15. The locking apparatus of claim 14 wherein said guiding rod is slidably mounted to said mounting assembly for undergoing sliding movement concurrently with sliding movement of said coupling rod.

16. The locking apparatus of claim 15 wherein said actuating assembly also includes a coiled spring which encircles one of said coupling and guiding rods for biasing said coupling rod toward said locking position.

17. A locking apparatus in combination with a toilet, said toilet including a bowl having a top opening, a flush tank located rearwardly and above said bowl, a seat overlying said top opening of the bowl, and a lid overlying said seat, said seat and lid having respective pairs of spaced seat and lid hinge brackets fixed on rear edge portions thereof and having end portions protruding from said rear edge portions of said seat and lid, said locking apparatus comprising:

(a) a mounting assembly attached to a front portion of said flush tank spaced above said bowl of said toilet so as to mount said seat and lid to undergo pivotal movement about a stationary pivot axis relative to said flush tank and bowl between a lowered position in which said seat and lid cover said top opening of said bowl and a raised position in which said seat and lid uncover said top opening of said bowl;

(b) an elongated coupling rod pivotally coupled to said mounting assembly and said end portions of said seat and lid hinge brackets for pivotal movement of said seat and lid between said lowered and raised positions and for slidable movement of said coupling rod relative to said mounting assembly and said seat and lid hinge brackets between locking and unlocking positions along said pivotal axis of said seat and lid being defined by said coupling rod, said elongated coupling rod having a pair of pins mounted thereon adjacent to selected ones of said seat and lid hinge brackets, said pins extending from said elongated rod in radial relation to said pivot axis of said seat and lid, said radial pins, upon sliding movement of said elongated rod between said locking and unlocking positions with said seat and lid in said lowered position, being matable with and unmatable from respective slots defined in transverse relation to said pivot axis and in said end portions of selected ones of said seat and lid hinge brackets such that said seat and lid are retained in said lowered position when said radial pins are mated with said transverse slots and are pivotally movable to said raised position when said radial pins are unmated from said transverse slots; and (c) an actuating assembly connected to said elongated coupling rod and mounted to said mounting assembly for undergoing sliding movement relative to said mounting assembly to cause sliding movement of said elongated coupling rod relative to said mounting assembly and said seat and lid hinge brackets between said locking and unlocking positions along said pivotal axis of said seat and lid.

18. The locking apparatus of claim 17 wherein said mounting assembly includes a pair of mounting brackets and an elongated shaft extending between and rigidly interonnecting said mounting brackets.

19. The locking apparatus of claim 18 wherein said mounting assembly also includes fastening members connected to said mounting brackets and adapted to attach said mounting brackets to said flush tank at locations spaced above a portion of said bowl located rearwardly from said open top of said bowl and thereby mount said seat and lid via said coupling rod spaced above said rearward portion of said bowl.

20. The locking apparatus of claim 18 wherein said mounting assembly further includes a pair of link members mounted in fixed relation to said shaft and mounting brackets and extending forwardly therefrom toward said seat and lid.

21. The locking apparatus of claim 20 wherein said coupling rod is mounted through a pair of holes defined in forward ends of said link members of said mounting assembly for undergoing sliding movement relative thereto, said coupling rods also mountable through passages defined in said end portions of said seat and lid hinge brackets so as to couple said seat and lid for pivotal movement between said lowered and raised positions about said pivot axis defined by said coupling rod and for sliding movement between said locking and unlocking positions along said pivotal axis.

22. The locking apparatus of claim 21 wherein said coupling rod has said pair of pins mounted thereon adjacent to said end portions of said selected ones of said seat and lid hinge brackets and extending from said coupling rod in radial relation to said pivot axis.

23. The locking apparatus of claim 21 wherein said actuating assembly includes:

an elongated guiding rod slidaldy associatied with said link members; and a cross brace rigidly interconnecting said guiding rod and said coupling rod such that said guiding and coupling rods extend in generally parallel relation to one another.

24. The locking apparatus of claim 23 wherein said guiding rod is mounted through a pair of apertures defined in middle portions of said link members of said mounting assembly for undergoing sliding movement concurrently with sliding movement of said coupling rod.

25. The locking apparatus of claim 24 wherein said actuating assembly also includes a coiled spring encircles one of said coupling and guiding rods for biasing said coupling rod toward said locking position.

26. The locking apparatus of claim 18 wherein said actuating assembly includes a knob attached on an outer end of said coupling rod for gripping to move said rod between said locking and unlocking positions.

* * * * *